US011185107B2

(12) United States Patent
Righter

(10) Patent No.: US 11,185,107 B2
(45) Date of Patent: Nov. 30, 2021

(54) CONVERTIBLE WATER PIPE

(71) Applicant: Otter Society, LLC, San Diego, CA (US)

(72) Inventor: James Righter, Durango, CO (US)

(73) Assignee: OTTER SOCIETY, LLC, San Diego, CA (US)

( * ) Notice: Subject to any disclaimer, the term of this patent is extended or adjusted under 35 U.S.C. 154(b) by 7 days.

(21) Appl. No.: 16/911,286

(22) Filed: Jun. 24, 2020

(65) Prior Publication Data

US 2020/0352223 A1 Nov. 12, 2020

Related U.S. Application Data

(63) Continuation-in-part of application No. 15/641,154, filed on Jul. 3, 2017, now abandoned.

(51) Int. Cl.

| | |
|---|---|
| ***A24F 1/30*** | (2006.01) |
| ***A24F 1/28*** | (2006.01) |
| ***A24F 1/32*** | (2006.01) |
| ***A24F 7/02*** | (2006.01) |
| ***A24F 5/00*** | (2006.01) |

(52) U.S. Cl.

CPC ..... *A24F 1/30* (2013.01); *A24F 1/28* (2013.01); *A24F 1/32* (2013.01); *A24F 5/00* (2013.01); *A24F 7/02* (2013.01)

(58) Field of Classification Search

CPC ..... A24F 1/30; A24F 1/02; A24F 1/32; A24F 5/00; A24F 7/02

See application file for complete search history.

(56) References Cited

U.S. PATENT DOCUMENTS

| | | | | |
|---|---|---|---|---|
| 4,096,868 | A * | 6/1978 | Norman | A24F 1/30 131/173 |
| 9,138,018 | B1 * | 9/2015 | Walmsley | A24F 1/30 |
| 2012/0180803 | A1 * | 7/2012 | Beloni | A24F 1/30 131/173 |
| 2014/0130811 | A1 * | 5/2014 | Touzjian | A24F 1/30 131/173 |
| 2016/0366931 | A1 * | 12/2016 | Zhang | F16L 37/004 |

FOREIGN PATENT DOCUMENTS

| | | | | |
|---|---|---|---|---|
| WO | WO-2017096452 | A1 * | 6/2017 | A24F 1/30 |

* cited by examiner

*Primary Examiner* — Alex B Efta

(74) *Attorney, Agent, or Firm* — Joseph C. Andras; Myers Andras LLP

(57) ABSTRACT

A smoking apparatus or water pipe comprised of one or more hollow or tubular section openings connected by a butt seal. The butt seal is formed by affixing a ring magnet to the exit opening of one section and affixing a second ring magnet the entrance opening of a second section. When the sections are joined, the ring magnets form a watertight and airtight seal between the two openings such that the need for a flange or other similar structure and or additional seal is unnecessary to maintain the integrity of the joint. A second embodiment employs interconnect assemblies inserted into select ends of the glass fixtures in order to seal thereto with gaskets/sealing rings and to provide a flush face within which is embedded a ring magnet for magnetically interconnecting adjacent glass members.

9 Claims, 7 Drawing Sheets

CONVERTIBLE WATER PIPE

This application is a continuation-in-part of application Ser. No. 15/641,154, filed Jul. 3, 2017, now pending.

BACKGROUND OF THE INVENTION

1. Field of the Invention

This invention relates generally to smoking apparatus and, more specifically, to a Convertible Water Pipe.

2. Description of Related Art

Water pipes are commonly used to smoke substances such as tobacco, *cannabis*, or other herbs. Typically, a water pipe includes combustion chamber or bowl to hold the combustible material, a downstem that permits smoke to travel from the combustion chamber to a main body of the pipe, and a mouthpiece where the user can inhale the smoke. The body is often filled with water such that the smoke exiting the downstem percolates through the water and is filtered and cooled. Water pipes need to be both airtight and water tight such that smoke from the combustion chamber can be drawn down through the downstem, percolate through the water, and be inhaled at the mouthpiece. Often, water pipes are made from glass and are formed in ornate shapes. This results in a water pipe that is fragile and prone to breakage.

Previous water pipes have utilized removable connections to join sections of the water pipe to one another. Such designs have utilized a flange connection with a magnet and a seal to prevent leakage of smoke or water. This particular arrangement is not conducive to the use of sections made from glass.

Therefore, what is needed is a water pipe that can be formed from glass with removablely connected sections that when connected form a watertight and airtight seal.

SUMMARY OF THE INVENTION

The present invention is a water pipe with removably connected sections. The water pipe includes numerous sections such as a combustion chamber or bowl that holds the combustible material, a downstem in the form of a tube that permits smoke to travel from the combustion chamber to a main body of the pipe, and a mouthpiece where the user can inhale the smoke. The combustion chamber is configured to hold combustible material that when lit begins to smoke. The body of the water pipe is filled with water. Smoke from a lit pipe is drawn down through the downstem and then percolates through the water in the body to filter the smoke. The smoke is then inhaled through the mouthpiece. It is therefore important that the water pipe is both watertight and airtight.

The water pipe of the present invention is preferably made from glass, although it may be made of other known materials as well. Typically, glass water pipes are ornate glass works that may include extensions from the body of the water pipe. For example, the combustion chamber may be of a size and shape that makes its extension from the body and connection to the downstem fragile. Likewise, the mouthpiece may extend from the body in a precarious configuration. Thus, although a one-piece continuous glass structure achieves the goal of being watertight and airtight, the structure is prone to catastrophic breakage of one or more sections.

The present invention utilizes ring magnets to create a butt seal between sections of the water pipe. For example, the combustion chamber of a water pipe typically extends well beyond the side of the body making it a fragile section. In one embodiment of the present invention, the exit opening of the combustion chamber and the entrance to the downstem are both fitted with ring magnets such that the connection between the combustion chamber and the downstem is an airtight butt seal. The butt seal is a watertight and airtight sealed connection between the exit opening of one section of the water pipe and the entrance opening of an adjoining section without the use of a flange, male female connection, or additional sealing element such as an O-ring. The butt seal of the present invention is created by the magnetic forces generated between the two ring magnets attached to the respective sections. The strength of the magnets is sufficient to form a secure watertight and airtight connection between the sections that can be disconnected for any reason or if the connection experiences a force that would have otherwise broken a standard glass connection. An alternate version replaces the magnets adhered to the glass fixtures with interconnect assemblies that are essentially plugs that seal to the tubular portions of the glass fixtures and that incorporate the magnetic rings.

This invention will become more fully understood from the following detailed description, taken in conjunction with the accompanying drawings described herein below, and wherein like reference numerals refer to like parts.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Convertible Water Pipe.

Figure 1:
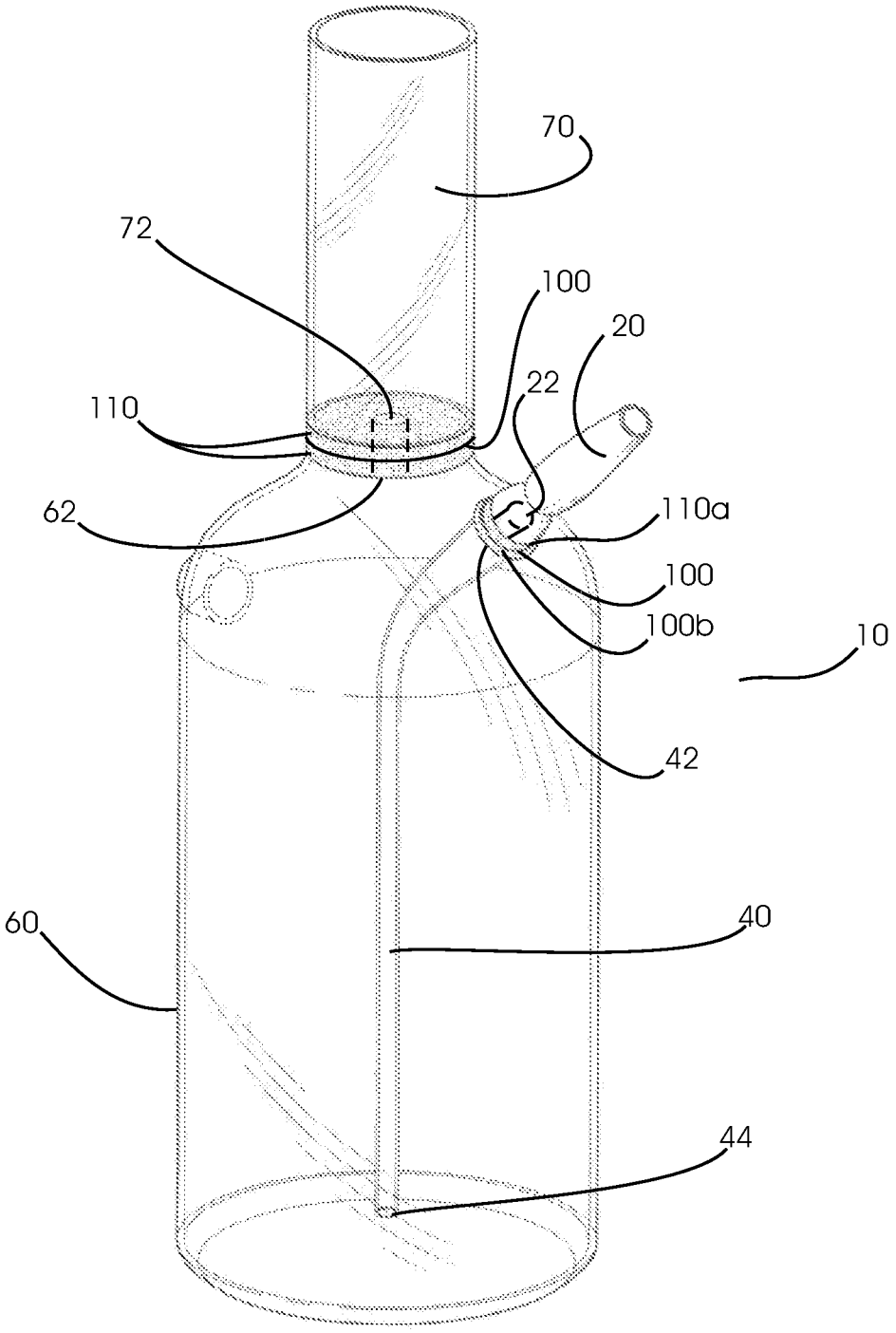
FIG. 1 is a perspective view of the water pipe of a first embodiment of the present invention showing the combustion chamber and the mouthpiece connected with a butt seal.

The present invention can best be understood by initial consideration of FIG. 1.[1] FIG. 1 is a perspective view of the water pipe of a first embodiment of the present invention showing the combustion chamber and the mouthpiece connected with a butt seal.

Referring to FIG. 1, the first embodiment of the present invention is a water pipe 10 with removably connected sections. The water pipe 10 includes a combustion chamber 20 connected to a tubular downstem 40 by a watertight and airtight butt seal 100 that permits smoke to travel from the combustion chamber to a main body 60 of the pipe 10, and a mouthpiece 70 where the user can inhale the smoke from the body 60. The combustion chamber 20 is configured to hold combustible material that when lit begins to smoke. The body 60 of the water pipe is filled with water. Smoke from a lit pipe is drawn down through the downstem 40 and then percolates through the water in the body to filter the smoke. The smoke is then inhaled through the mouthpiece. It is therefore important that the entirety water pipe is both watertight and airtight such that neither smoke escapes when the pipe is in use nor water leaks from the pipe.

The water pipe 10 of the present invention is preferably made from glass, although it may be made of other known materials as well. Often, glass water pipes are glass works that include ornate appendages extending precariously from the body 60 of the water pipe 10. Such a configuration creates fragile sections of the water pipe 10 that tend to break or need repair. Once a section of glass breaks from the water pipe, the pipe is inoperable. For example, typically the combustion chamber 20 may be of a size and shape that makes it project from the body and create a fragile connection to the downstem 40. The butt seal connection between the combustion chamber and the downstem eliminates the concern of breakage. Likewise, the mouthpiece may extend from the body in a perilous configuration. A one-piece continuous glass structure achieves the goal of being watertight and airtight but is prone to catastrophic breakage of one or more sections. A butt seal eliminates the possibility of breakage but achieves the goal of being watertight and airtight.

The first embodiment of the present invention, as shown in FIGS. 1-4, overcomes the limitations of a one-piece continuous glass structure by utilizing a desired number of ring magnets 110 to create the butt seal 100 between sections of the water pipe 10. The butt seal 100 is a watertight and airtight sealed connection between the exit opening of one section and the entrance opening of an adjoining section without the use of a flange, male/female joint configuration, and or additional sealing element such as an O-ring. Both the exit opening of a first section and the entrance opening of a second section are affixed with ring magnets 110. The ring magnets create an attractive force sufficient to form a secure watertight and airtight connection between the sections that can be disconnected for any reason or if the connection experiences a force that would have otherwise broken a standard glass connection.

Figure 2:
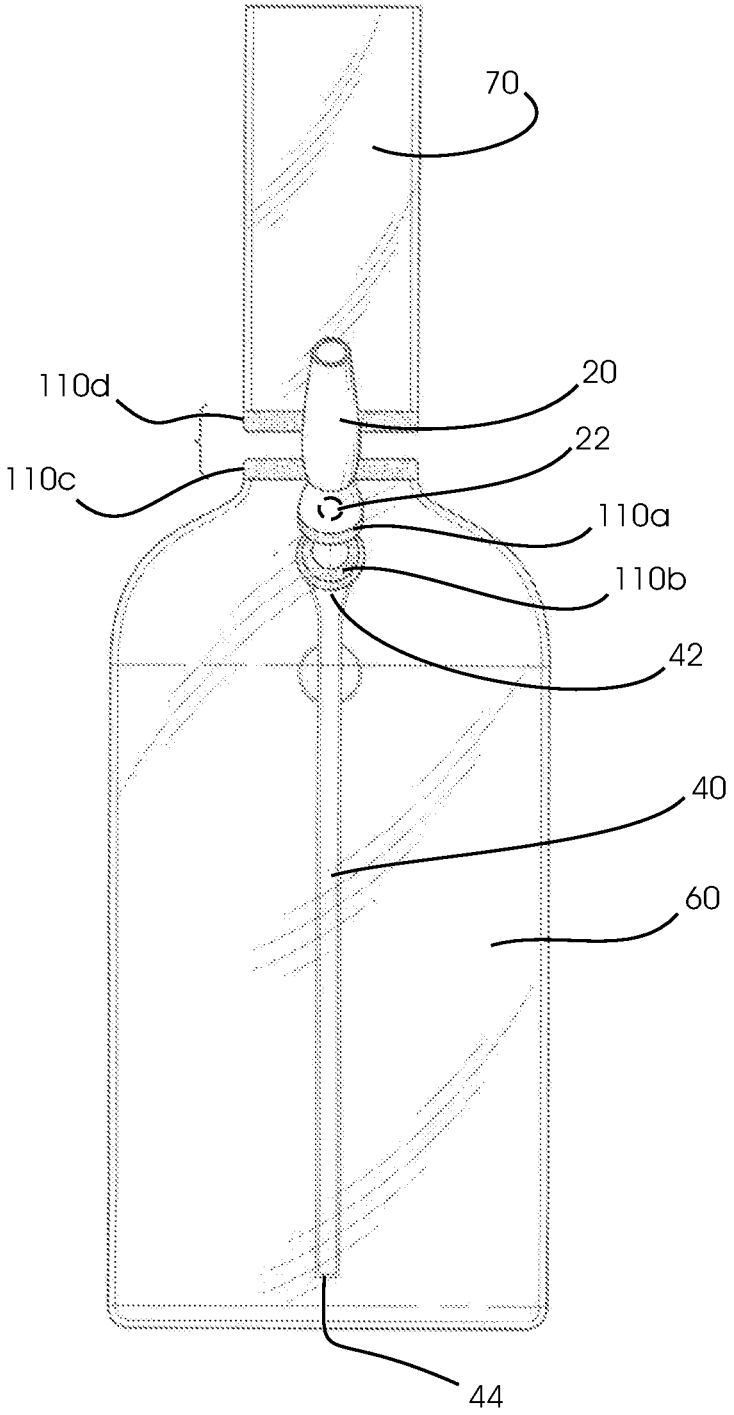
FIG. 2 is a front view of an embodiment the invention with both the combustion chamber and the mouthpiece shown removed.
Figure 3:
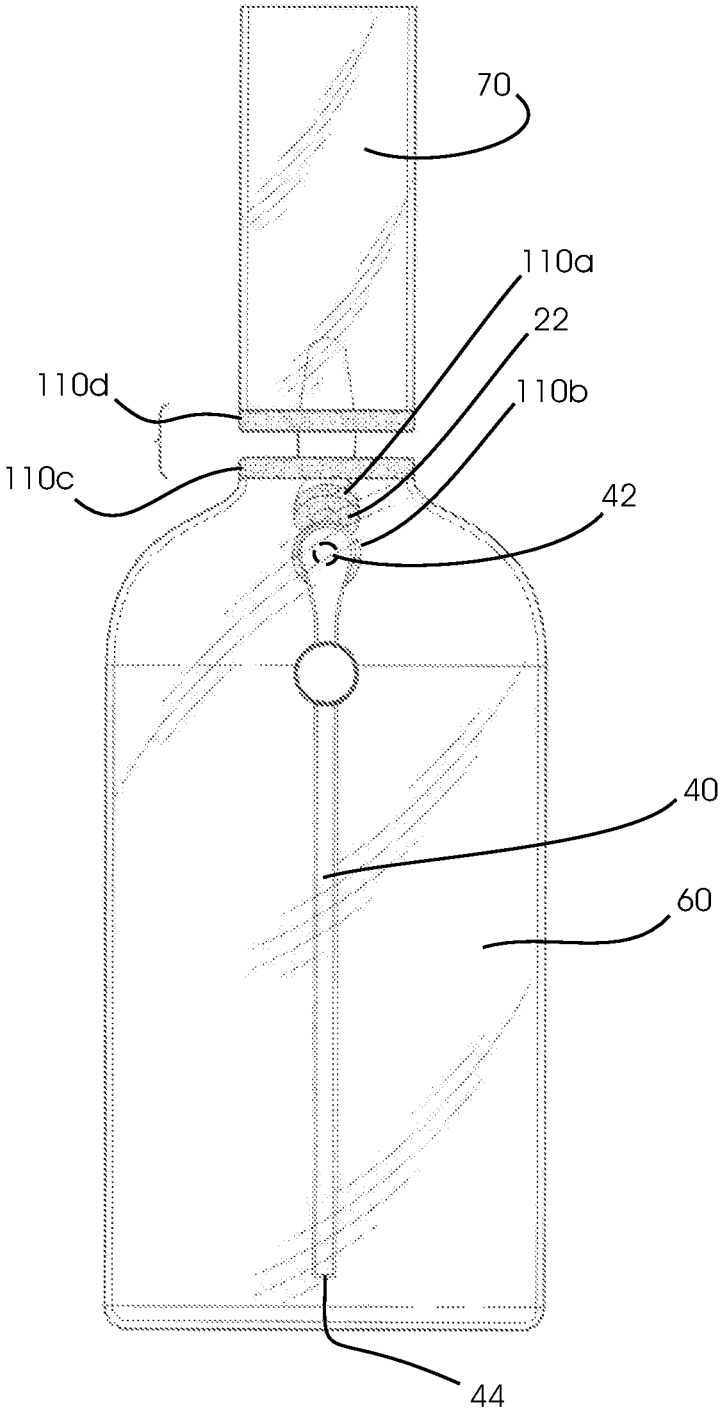
FIG. 3 is an end view of an embodiment the invention with both the combustion chamber and the mouthpiece shown removed.
Figure 4:
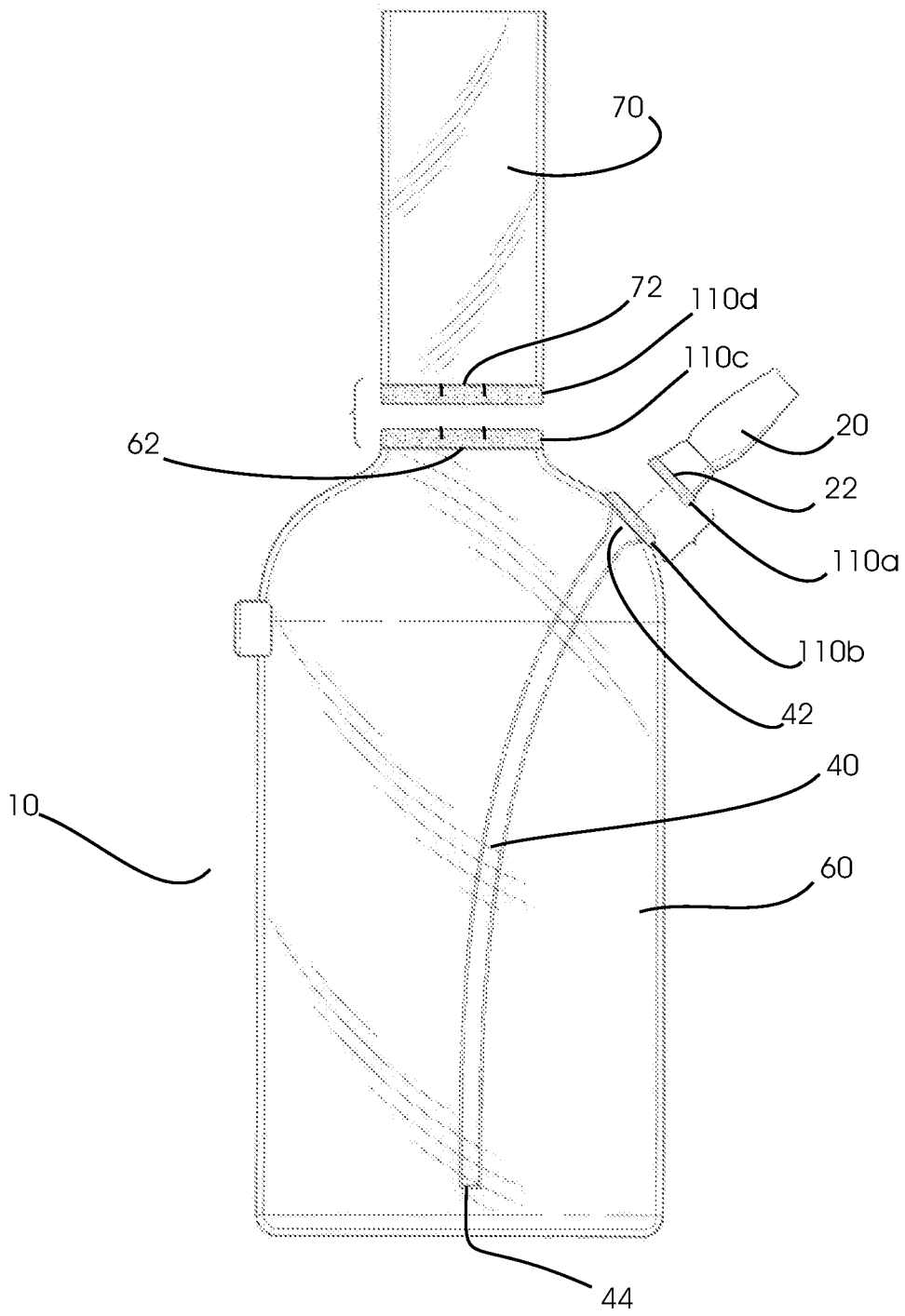
FIG. 4 is a side view of an embodiment the invention with both the combustion chamber and the mouthpiece shown removed.

FIG. 2 shows an embodiment of the combustion chamber 20. The combustion chamber 20 may be bowel shaped to contain material such as herbs, tobacco, or *cannabis* that is lit by the user. As shown in FIG. 3, the combustion chamber has an exit opening 22 that permits the smoke from the lit material to be drawn into the pipe. In an alternative embodiment, the combustion chamber 20 is in the form of a bucket configured to hold liquid combustible material. This embodiment similarly includes the exit opening 22 that permits the smoke from the lit material to be drawn into the pipe.

FIG. 2 shows an embodiment of the downstem 40 of the present invention, the downstem 40 is a tubular section of a water pipe 10 that transports smoke from the combustion chamber 20 into water held in the body of the water pipe. The entrance of the downstem 40 may protrude from the body 60 of the water pipe 10 or it may be is formed flush with the wall of the body 10. The down stem has a entrance opening 42 and an exit opening 44. The entrance opening 42 communicates with the exit opening of the combustion chamber 22. The exit opening 44 of the downstem 40 permits smoke to enter the body 60. One of skill in the art would recognize that many configurations would permit the combustion chamber 20 to connect to the downstem 40 with a butt seal 100.

One embodiment of the body 60 of the water pipe 10 is a straight walled flask shaped vessel with an opening at the top. The lower portion of the body 60 bulges outwardly then necks down toward the upper portion of the body 60 as shown in FIGS. 1-4. When in use, the body 60 is filled with water. The downstem 40 extends into the body and into the water. During use, smoke exits the combustion chamber, travels through the downstem 40 and out the exit opening 44 of the downstem into the water held in the body 60. The water held in the body 60 filters the smoke prior to it being inhaled by the user. In one embodiment, the upper portion of the body 60 is relatively a narrow opening that may be used as a mouthpiece 70. In another the mouthpiece is a separate section of the body 60. In such an embodiment, the mouthpiece has an entrance opening 72 that communicates with a mating exit opening of the body. In still a further embodiment, the mouthpiece 70 extends from the body in an ornate manner.

FIGS. 1-4, show a detailed view of the butt seal between the combustion chamber 20 and the downstem 40. A ring magnet 110*a* is affixed to the exit opening of the combustion chamber 22. The ring magnet 110*a* may be secured with an adhesive or it may be configured such that it can be molded in place utilizing the material of the combustion chamber 20. One of skill in the art would recognize numerous method of securing the ring magnet 110*a* to the exit opening of the combustion chamber. Magnetic material may be transferred to the glass to make a ring magnet 110*a* fixed to the combustion chamber exit opening 22. The size of the ring magnet 110*a* is generally the size of the opening of the combustion chamber, but larger or smaller magnets may be utilized. The strength of the magnet it sufficient to release from the seal in the event of an overloading situation, yet also sufficient to hold the sections of the water pipe in place. The ring magnet 110*a* is fixed substantially concentric to the opening. A second ring magnet 110*b* is affixed to the entrance opening 42 of the downstem 40. Similarly, the second ring magnet 110*b* may be secured in any manner suitable to maintain sufficient attachment and sized and located similar to the first ring magnet 110*a*. The magnets are attracted to each other to create the butt seal 100 to join the exit opening 22 of the combustion chamber 20 and the entrance opening 42 of the downstem 40 together without an additional seal such as an O-ring and without additional sealing and alignment features such as flanges or a male female connection.

In another embodiment of the present invention, the mouthpiece 70 of the body 60 of the water pipe is connected to the body using additional ring magnets 110 to create a butt seal 100. In this embodiment, the body 60 is configured such that it necks down to an exit opening 62. The exit opening 62 is fitted with a ring magnet 110*c*. Similarly the entrance opening 72 to the mouthpiece 70 is fitted with a mating, similar sized ring magnet 110*d*. When the two sections are connected, the ring magnets form a butt seal 100 between the body and the mouthpiece. The butt seal 100 is watertight and airtight, and it eliminates a need for a flange or additional sealing member.

It will be understood that the foregoing relates to exemplary embodiments of the invention and that modifications may be made without departing from the spirit and scope of the invention as set forth in the following claims. Any section of the water pipe may be connected to another using the butt seal of the present invention including sub-sections of an individual section.

Figure 5:
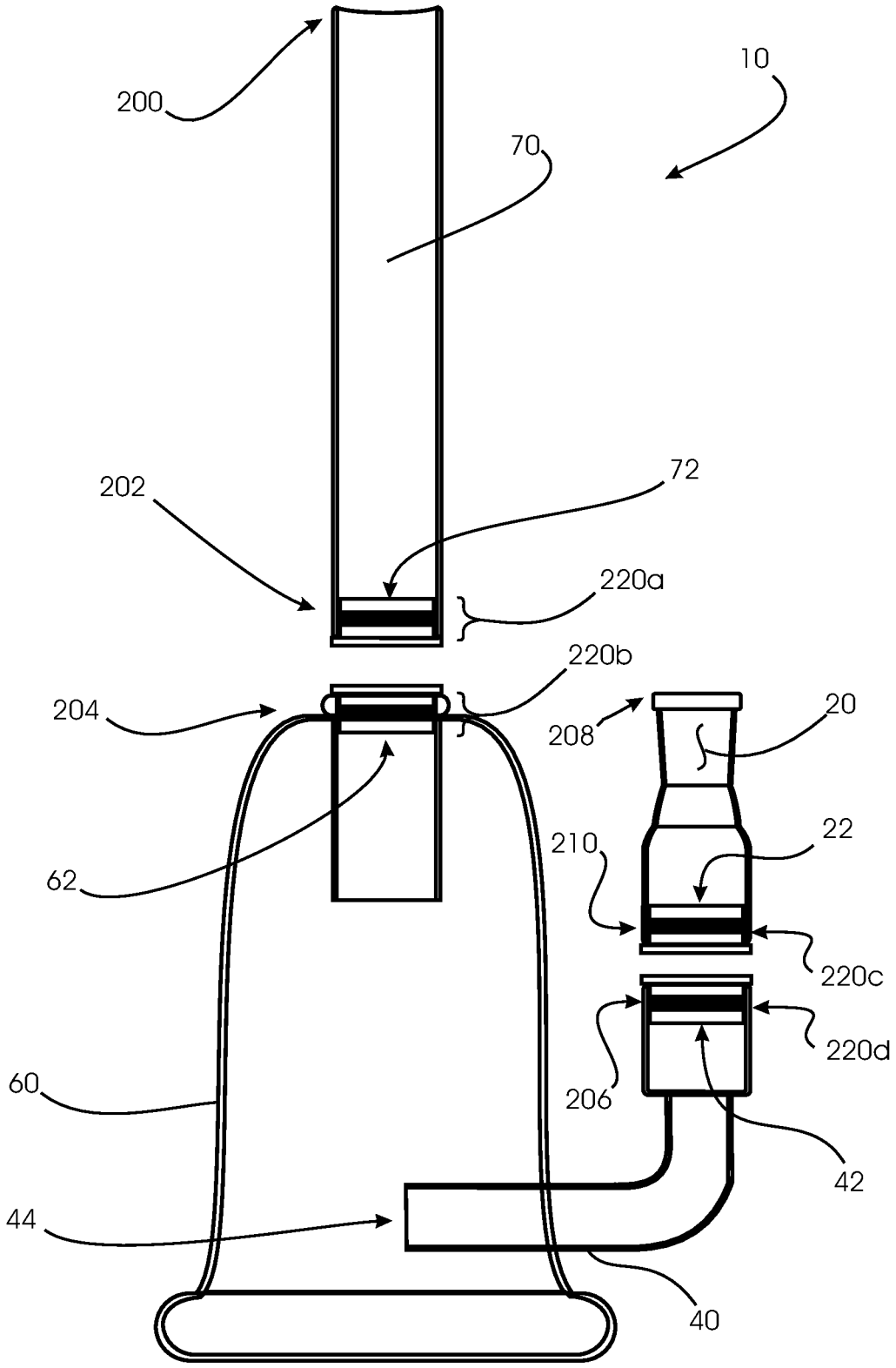
FIG. 5 is an exploded side view of an alternate version of a water pipe incorporating the interconnect assemblies of the present invention.

FIG. 5 is an exploded side view of an alternate version of a water pipe 10 incorporating the interconnect assemblies 220A, 220B, 220C and 220D of the present invention. In this version, the ring magnets [110] are not bonded to the glass of the pipe 10, but rather are embedded within interconnect assemblies that are inserted into, and seal to, the tubular glass of the water pipe 10. As shown here, interconnect assembly 220A has been inserted into the second end 202 of the mouthpiece 20. Interconnect assembly 220B has been inserted into the first end 204 of the main body 60. Each interconnect assembly 220A, 220B has a ring magnet (not shown) incorporated into them with each ring magnet [110] having an opposite magnetic polarity to the other so that the two interconnect assemblies 220A, 220B are magnetically attracted to one another with a strong enough force to create an airtight and watertight butt seal between the two assemblies 220A, 220B, while also permitting them to be separated from one one another.

Similarly, the combustion chamber 20 has an interconnect assembly 220C inserted into its second end 210. The second end 206 of the tubular downstem 40 has interconnect assembly 220D inserted into it that is also of opposite magnetic polarity as compared to the interconnect assembly 220C in the combustion chamber 20. As such, the combustion chamber second end 210 is magnetically drawn toward the downstem second end 206 to create a air- and water-tight butt seal between the assemblies 220C, 220D.

In its preferred form, the magnetic polarity of interconnect assemblies 220A and 220C should be opposite from one another. It therefore follows that the magnetic polarity of interconnect assemblies 220B and 220D are also opposite from one another. There are two reasons for this arrangement of magnetic polarities. First, it prevents the combustion chamber 20 from being attached to the first end 204 of the body 60, and would further prevent the mouthpiece 70 from being attached to the second end of the downstem 40, because these elements would magnetically repel one another. The second reason for this is explained below in connection with FIG. 6.

Figure 6:
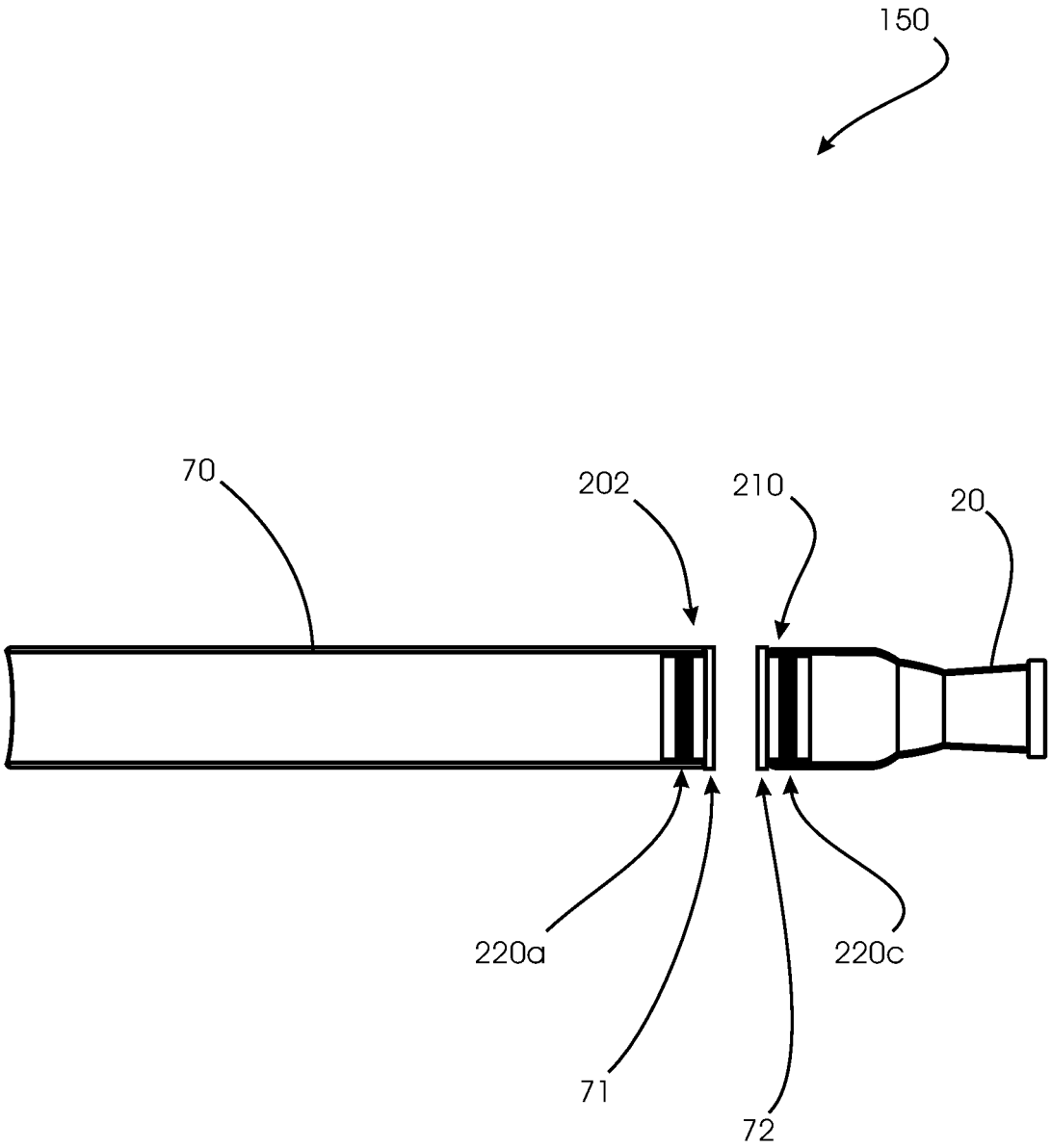
FIG. 6 is an exploded side view of a waterless pipe incorporating the interconnect assemblies of FIG. 5.

FIG. 6 is an exploded side view of a waterless pipe 150 incorporating the interconnect assemblies 220A and 220C of FIG. 5. As discussed above, interconnect assembly 220A and interconnect assembly 220C have opposite magnetic polarity, and as such, the second end 202 of the mouthpiece 70 is drawn towards the second end 210 of the combustion chamber 20. It is this relationship that provides the unique functionality of the water pipe 10 of FIG. 5. That pipe [10] is actually a convertible pipe—it can either function as a water pipe, or as a water-less pipe. The user need simply attach the mouthpiece 70 to the combustion chamber 20 to create a water-less pipe 150, or to attach these components to the main body 60 as shown in FIG. 5 in order to create a water pipe as in FIG. 5. No prior pipe provides this superior additional functionality. If we now turn to FIGS. 7 and 8, we can examine the details of the interconnect assemblies.

Figure 7:
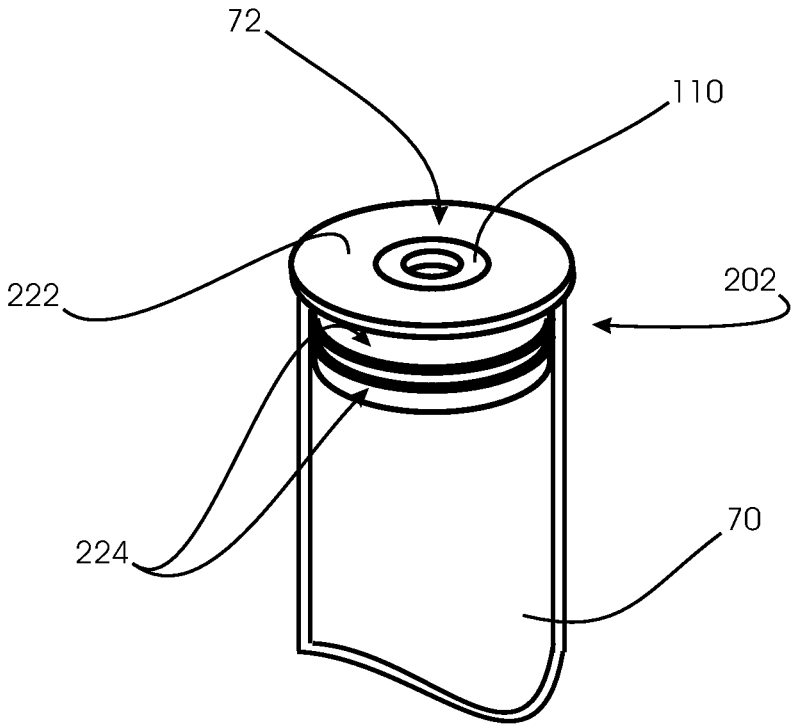
FIG. 7 is a partial cutaway perspective view of the second end of the mouthpiece of FIG. 5.
Figure 8:
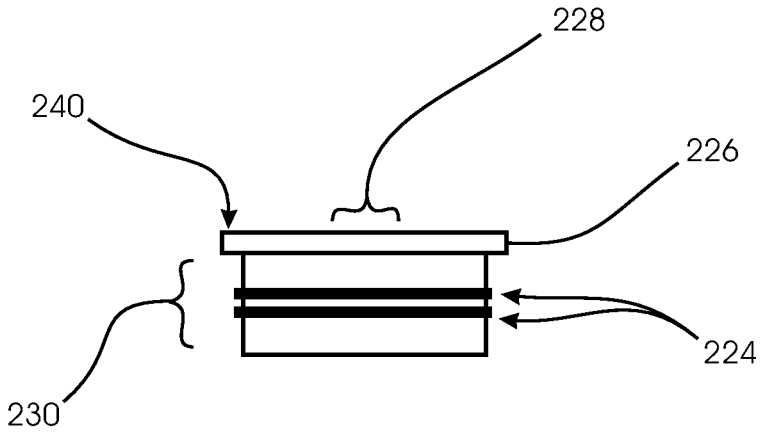
FIG. 8 is a side view of the interconnect assembly of FIG. 7.

FIG. 7 is a partial cutaway perspective view of the second end 202 of the mouthpiece 70 of FIG. 5, and FIG. 8 is a side view of the interconnect assembly 220A of FIG. 7. Each assembly 220A-220D comprises a non-ferrous (metal or non-metallic) plug 240 that is defined by a disc-shaped flange portion 226 and a cylindrically-shaped stem portion 230. The stem portion 230 has a diameter that is selected to be slightly smaller than is the interior diameter of the glass tube into which it is to be inserted (e.g. the mouthpiece [70] or the combustion chamber [20]). The disc-shaped flange portion 226 has a diameter that is larger than that of the stem portion 230, and preferably the same diameter as the outer diameter of the glass tube into which it is to be inserted.

The flange face 222 is smooth and flat, and has a magnet receptacle 228 formed within it. The magnet receptacle 228 is sized to cooperate with the ring magnet element 110 so that it can be inserted into the flange portion 226 and retained there such that the magnet element 110 is flush with the face 222 of the flange portion 226. The ring magnet element 110 is preferably pressed into the magnet receptacle 228 and retained there by an interference fit, or it could be attached with an acceptable adhesive, which is not preferred, but may be necessary in certain circumstances.

Each flange face is selected cooperatively such that when inserted into its respective glass tubular member, is juxtaposed over and substantially covers the rim of the glass tubular member. The rims 71, 72 of the mouthpiece 70 and combustion chamber 20 are identified in FIG. 6.

There are two or more pliable sealing rings 224 around the stem portion 230 of the plug 240. As should be apparent, when the interconnect assembly (e.g. 220A) is inserted into the glass tube (e.g. mouthpiece 70), the non-rigid, pliable sealing rings 224 would seal against both the interior surface of the mouthpiece 70 and the outer surface of the stem portion 230.

There are several benefits of the version of the invention described herein in connection with FIGS. 5-8. First, the tolerances between the interconnect assemblies 220A-220 and the glass tubes do not need to be nearly as tight as with the version described in connection with FIGS. 1-4. Second, the flange portion 226 protects the delicate glass edge of the tubular member into which it is inserted. Third, since the ring magnet 110 is affixed to the plug 240 with an interference fit, the new approach eliminates the need for adhesives anywhere near the airflow of the pipe. Finally, the approach allows for the low-cost, mass production of the interconnect assemblies promotes large-scale distribution of the final product.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A water pipe comprising:

a glass body having a mouthpiece;

a glass downstem coupled to the body having a first opening located inside the body, a second opening exiting from the body, and a first ring magnet fixed to a first interconnect assembly inserted into the second opening, said first interconnect assembly comprising:

a first plug element defined by a flange face; and said first ring magnet fixed to said first plug element such that said first ring magnet defines a face that is generally flush with said flange face;

a glass combustion chamber configured for the combustion of material, the combustion chamber having a first opening and an exit opening and including a second ring magnet fixed to a second said interconnect assembly inserted into the exit opening; and wherein the first ring magnet and the second ring magnet form a substantially watertight and airtight butt seal between the combustion chamber and the downstem such that gases formed in the combustion chamber may flow into the downstem.

2. The water pipe of claim 1, wherein said combustion chamber is removable from said glass downstem second opening.

3. The water pipe of claim 2, wherein said glass body is further defined by a body exit opening extending from said glass body and a third said interconnect assembly inserted into said body exit opening, said third interconnect assembly comprising:

a second plug element defined by a flange face; and a third ring magnet fixed to said second plug element such that said third ring magnet defines a face that is generally flush with said flange face; and said mouthpiece defined by mouthpiece entrance opening within which a fourth said interconnect assembly is inserted, said fourth interconnect assembly comprising:

a third plug element defined by a flange face; and a fourth ring magnet fixed to said third plug element such that said fourth ring magnet defines a face that is generally flush with said flange face.

4. The water pipe of claim 3, wherein each said interconnect assembly comprises:

a plug element defined by a stem portion insertible into said openings and terminating in a flange portion, said flange portion defined by said flange face and a magnet receptacle formed therein within which a ring magnet fits and is fixed.

5. The water pipe of claim 4, further comprising at least one relatively pliable and non-rigid sealing ring around each said stem portion of said interconnect assembly.

6. The water pipe of claim 3, wherein said ring magnets are oriented within their respective said interconnect assemblies such that the magnetic field at said first and fourth interconnect assemblies define a first magnetic field orientation and the magnetic field at said second and third interconnect assemblies define a second magnetic field orientation, whereby said first interconnect assembly magnetically attracts said second interconnect assembly but magnetically repels said fourth interconnect assembly, and said second interconnect assembly magnetically attracts said fourth interconnect assembly, but said second interconnect assembly is repelled by said third interconnect assembly.

7. A smoking apparatus, comprising:

a tubular mouthpiece defining a second end terminating in a rim;

a tubular combustion chamber defining a second end terminating in a rim;

first and second interconnect assemblies, each said interconnect assembly comprising:

a plug formed from non-ferrous material, said plug defined by a stem portion sized to be received within said mouthpiece and said combustion chamber through said rims, said plug further defined by a flange portion that defines a diameter substantially equal to said rims;

a ring magnet affixed one each to each said flange portion such that faces defined by said ring magnets are coplanar with faces defined by said flange portions; and said ring magnets are fixed to their respective interconnect assemblies such that said flange faces of said first and second interconnect assemblies are magnetically attracted to one another to form a detachable airtight and watertight seal between said flange faces.

8. The smoking apparatus of claim 7, further comprising a main body, said main body comprising:

a tubular body exit opening terminating in a rim;

a tubular downstem protruding into said main body and extending outwardly to terminate in an exit opening defined by a rim;

third and fourth interconnect assemblies, said third interconnect assembly inserted into said body exit opening and said fourth interconnect assembly inserted into said downstem exit opening, each said interconnect assembly comprising:

a plug formed from non-ferrous material, said plug defined by a stem portion sized to be received within said body exit opening and said tubular downstem exit opening through said rims, said plug further defined by a flange portion that defines a diameter substantially equal to said rims;

a ring magnet affixed one each to each said flange portion such that faces defined by said ring magnets are coplanar with faces defined by said flange portions; and said ring magnets are fixed to their respective interconnect assemblies such that said flange faces of said first interconnect assembly is magnetically attracted to said third interconnect assembly and said second interconnect assembly is magnetically attracted to said fourth interconnect assembly to form a detachable airtight and watertight seal between said flange faces.

9. The smoking apparatus of claim 8, wherein each said interconnect assembly further comprises a pair of sealing rings dispersed around and along each said stem portion of said plugs.

* * * * *